US005967600A

United States Patent [19]

Jelacic et al.

[11] Patent Number: 5,967,600

[45] Date of Patent: Oct. 19, 1999

[54] CONVERTIBLE WORK STATION

[76] Inventors: Matthew Jelacic; Deborah Gans, both of 350 Fifth Ave. Room 8006, New York, N.Y. 10118

[21] Appl. No.: 09/106,514

[22] Filed: Jun. 29, 1998

[51] Int. Cl.[6] ..... A47B 3/14

[52] U.S. Cl. ..... 297/142; 108/11; 108/38; 297/123; 297/139

[58] Field of Search ..... 297/119, 123, 297/139, 142; 108/11, 38

[56] References Cited

U.S. PATENT DOCUMENTS

| | | | |
|---|---|---|---|
| 1,182,339 | 5/1916 | Bekesi | 297/142 |
| 2,145,201 | 1/1939 | Raeuber | 297/142 |
| 2,348,573 | 5/1944 | Rogers | 297/142 |
| 5,333,928 | 8/1994 | Rollinson | 297/142 |

FOREIGN PATENT DOCUMENTS

| | | | |
|---|---|---|---|
| 641325 | 8/1950 | United Kingdom | 297/142 |

*Primary Examiner*—Peter R Brown
*Attorney, Agent, or Firm*—Michael Ebert

[57] ABSTRACT

A convertible work station composed of chair and desk sections which are separated from each other in an active mode of the station and are combined in a storage mode to form a compact cube having square faces. The chair section is defined by a seat mounted between parallel front and rear side panels bridged by a square end panel to form an alcove, the rear side panel also being square and the front side panel being half square. The desk section is defined by a square desk top mounted on an L-shaped base formed by a square rear side panel hinged to the square rear panel of the chair section, and a half-square end panel.

16 Claims, 2 Drawing Sheets

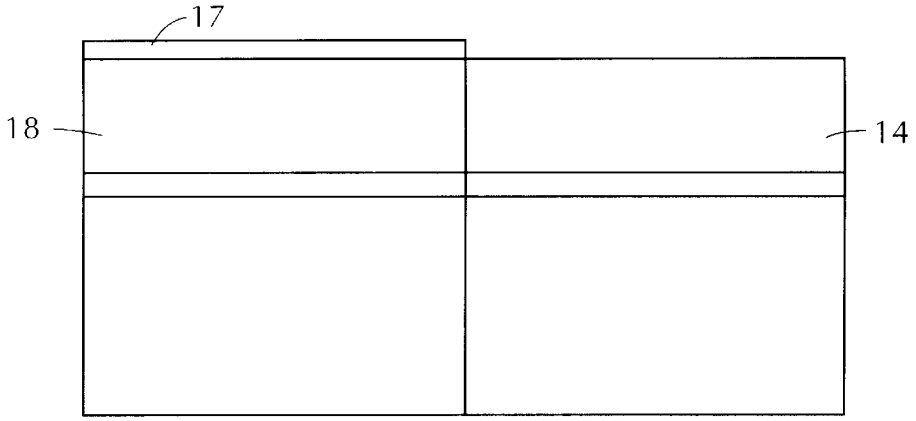
FIG. 2
FIG. 3
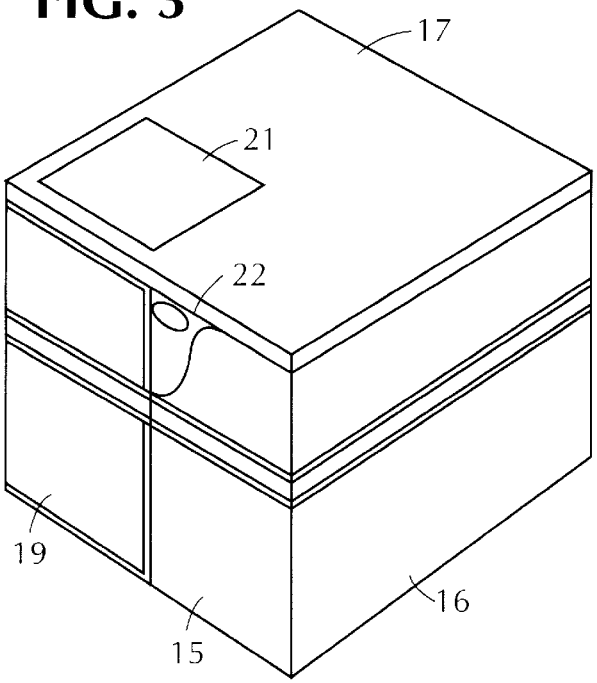
FIG. 5
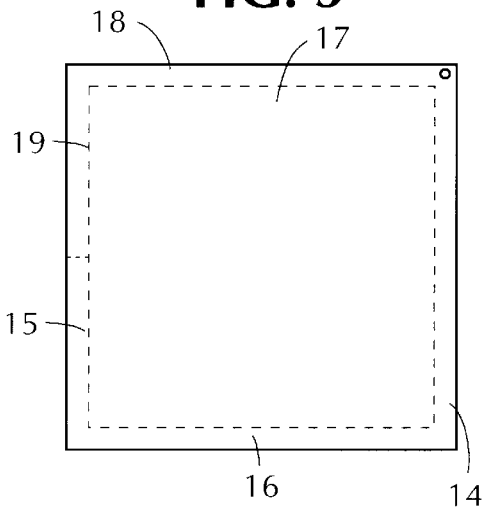
FIG. 4
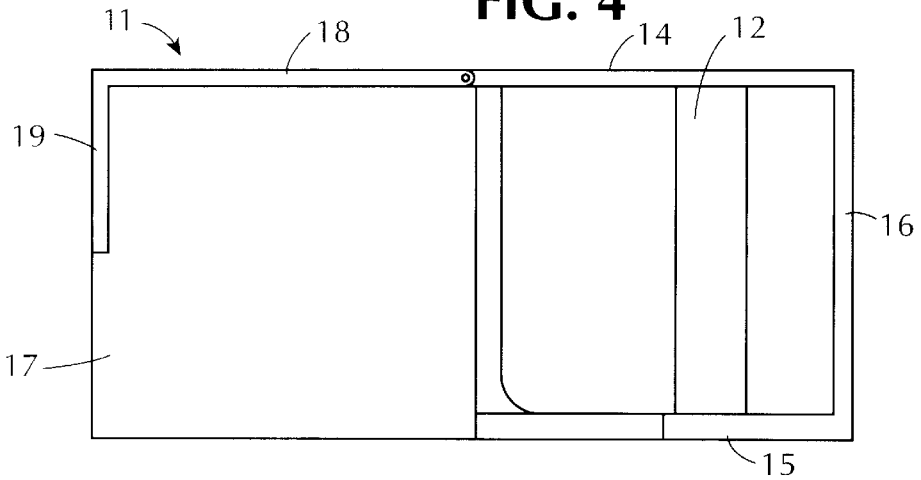

CONVERTIBLE WORK STATION

BACKGROUND OF INVENTION

1. Field of Invention

This invention relates generally to work stations, and more particularly to a station having interhinged chair and desk sections which are separated in the active mode of the station to create an entry into the station, and are combined in the storage mode to form a compact cube.

2. Status of Prior Art

A work station is a segregated area usually in an office, that is outfitted with a desk and a chair for a single worker. The station is furnished with other equipment necessary to the worker's activity, such as a computer and a computer terminal or a word processor.

To create several work stations in an office facility, the common practice is to partition the available space into alcoves, each large enough to accommodate a desk and a chair and whatever equipment is required by a worker occupying the alcove.

The serious drawback of this multiple work station arrangement is its lack of flexibility, for the partitioning of the available space must be such as to make each alcove accessible without having to pass through other alcoves. Hence it is not possible to rearrange the configuration of the alcoves without radically changing the partitioning.

All work stations must provide the worker with a desk. If the ground area defined by the work station is small, there may not be adequate room to accommodate a standard office desk. Thus in the space divider system disclosed in the Morrison patent U.S. Pat. No. 5,024,030, assigned to Knoll International, Inc., a well-known producer of office furniture, the work station is such as to integrate the desk with the panels forming the walls of the station. In the Morrison arrangement, the panels are interconnected by slotted vertical posts adapted to support brackets which are cantilevered from the posts, a desk top being mounted on these brackets. One can also mount shelves on other brackets within the work station.

The concern of the present invention is with a self-sufficient work station that can be placed wherever a suitable site is available in an-office, a school, a factory or other facility. An example of such a work station is a library carrel for private study which takes the form of a partitioned nook adjacent the stacks in a library.

A typical carrel is provided with a small desk placed within the enclosure and a chair positioned next to the desk. The drawback of a carrel or other self-sufficient work station is that it occupies as much space when in use as when it is vacant.

In this age of information, computers linked to an Internet highway are essential to students. In some schools, work stations are provided for individual student use, each station being equipped not only with a desk and a chair, but also with a computer and a computer terminal. In this way a student occupying the station has access to a world-wide reservoir of information.

It is desirable that students not only be provided with computers, but that the students be-given an environment conducive to the efficient use of computer. To this end, a work station is the best environment for a computer, for it gives the student operating the computer the privacy he needs to operate the computer and to observe the computer terminal without being distracted by other students operating computers.

In many schools, whether public or private, space is at a premium and therefore must be put to efficient use. When a significant portion of the available space in a school is occupied by work stations, these stations which are only in use for a limited period by students in the course of a school day, nevertheless preempt the use of the space occupied by the stations.

Self-sufficient work stations, when not in use, may be shifted to one side of a room or to a storage area. But in either case, the work stations occupy as much space when not in use as when in use. And storage areas in most schools are incapable of accommodating a large number of work stations.

There is therefore not only a growing need for computer-equipped work stations, but also stations of this type that when not in use take up a relatively small space. Yet in modern schools, there is increasing pressure to provide the students with computers, for to educate the student and make available to him the wealth of information to which a computer has access, the student must be taught to operate a computer. Thus there is not only a growing need for computer-equipped work stations, but also for work stations that when not in use, can be converted into a more compact storable form.

SUMMARY OF INVENTION

In view of the foregoing, the main object of this invention is to provide a self-sufficient work station which when in use requires a modest amount of space, and when not in use requires far less space.

More specifically, an object of this invention is to provide a work station of the above type which is convertible from an active mode in which it occupies a modest space, to a storage mode in which the station assumes the form of a cube that requires far less space.

Among the significant features of the invention are the following:

A. The work station is composed of interhinged chair and desk sections which in the active mode of the station are separated from each other and in the storage mode are combined to create a cube.

B. In the storage mode, the ground space required by the station is equal to the dimensions of a square face of the cube.

C. The desk section of the work station includes a cubby to accommodate a computer and a computer terminal.

D. Though the work station in its active mode occupies a modest space, it is sufficiently commodious to provide storage space for books, backpacks and other items useful to a student or other worker using the station.

E. In the storage mode, the work station assumes the form of a locked cube which acts as a security vault for the computer and other items housed in the cube.

Also an object of the invention is to provide a work station whose enclosure is formed by panels, each having a metal frame in which is insertable boards that serve different purposes, such as black boards and peg boards.

Briefly stated, these objects are attained by a convertible work station composed of chair and desk sections which are separated from each other in an active mode of the station and are combined in a storage mode to form a compact cube having square faces. The chair section is defined by a seat mounted between parallel front and rear side panels bridged by a square end panel to form an alcove, the rear side panel also being square and the front side panel being half square.

The desk section is defined by a square desk top mounted on an L-shaped base formed by a square rear side panel hinged to the square rear panel of the chair section, and a half-square end panel.

In the active mode, the interhinged square rear panels of the two sections are in co-planar relation to create a front entry to the work station, permitting a worker to occupy the seat and work on the desk. In the storage mode, the hinged chair section is turned ninety degrees with respect to the desk section to bring the half-square front side panel of the chair section into line with the half-square end panel of the desk section, thereby forming a square face that completes a cube whose other faces are formed by the square end panel, the square desk top and the square rear side panels.

BRIEF DESCRIPTION OF DRAWING

For a better understanding of the invention, as well as further features thereof, reference is made to the detailed description thereof to be read in connection with the annexed drawings wherein:

FIG. 2 is a rear view of the station in this mode;

FIG. 3 is a perspective view of the work station in its storage mode in which it assumes the shape of a cube;

FIG. 4 shows the geometry of the work station in its active mode;

FIG. 5 shows the geometry of the work station in its storage mode; and

DESCRIPTION OF INVENTION

The Work Station

Figure 1:
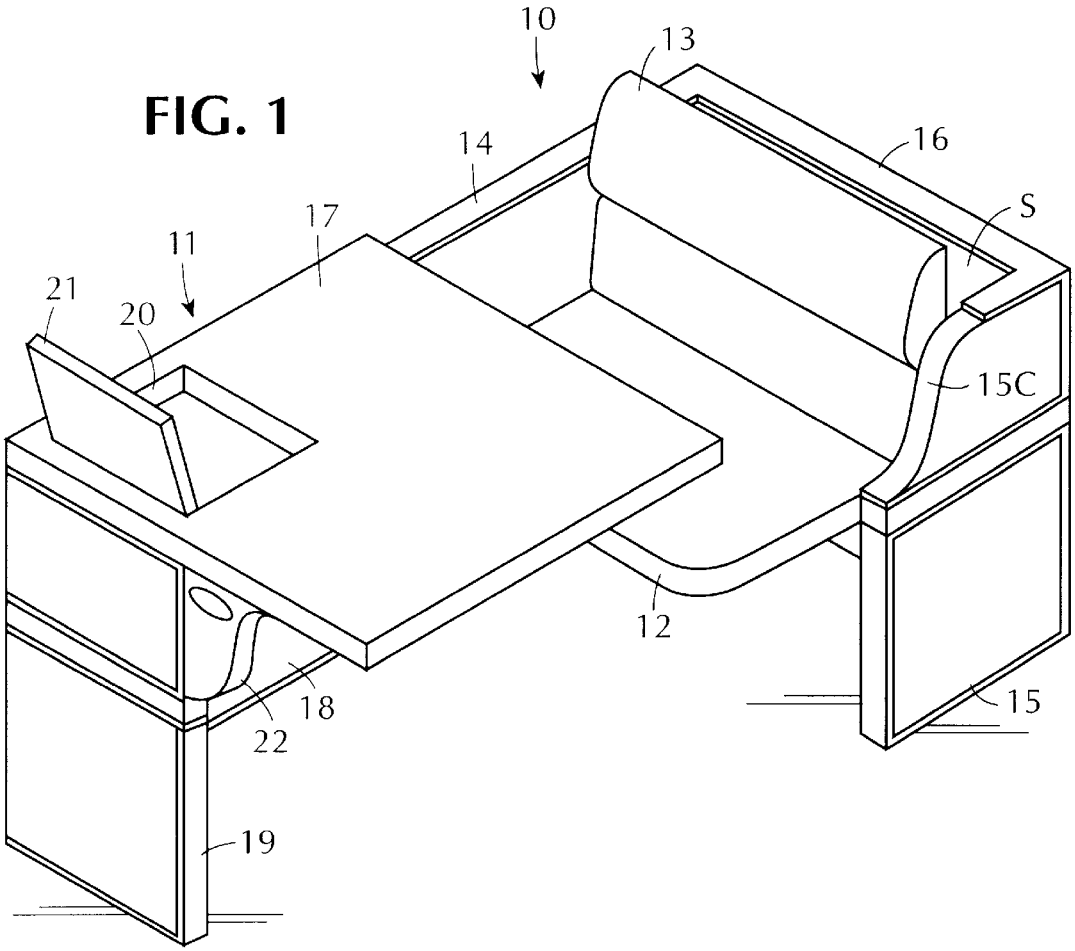
FIG. 1 is a perspective view of a work station in accordance with the invention as it appears in an active mode.

Referring now to FIGS. 1 and 2, a work station in accordance with the invention is composed of a chair section 10 hinged to a desk section 11. In an active mode of the station in which it is useable by a student or other worker, the desk section is separated from the chair section so that a worker occupying the chair can work on the desk. But in a storage mode of the station, the sections are combined to create a cube as shown in FIG. 3.

Chair section 10 includes a seat 12 provided with a foldable back rest 13 which is normally raised. Seat 12 is mounted between parallel rear and front side panels 14 and 15 which are bridged by an end panel 16 to form a bay or alcove enclosure. Rear side panel 14 and end panel 16 of the alcove are square, having like dimensions. The front side panel 15 is half-square and therefore rectangular.

Desk section 11 includes a square desk top 17 whose dimensions match those of the square panels in the chair section 10. Desk top 17 is mounted an L-shaped base having a square rear side panel 18 joined to a half-square end panel 19. The square rear side panel 18 of the desk section is hinged to the square rear side panel 15 of chair section 10, so that the chair section can be swung relative to the desk section.

To accommodate a computer and a computer terminal, desk section 11 is provided with a cubby to which access is had by way of a cubby hole 20 cut into desk top 17. Desk top 17 is preferably fabricated of a wood laminate so that it is perfectly flat and provides a-good work surface. Cubby hole 20 is covered by a hinged lid 21 which when closed is flush with the surface of the desk top. The computer in the cubby is provided with a video terminal that is integrated with lid 21, so that when the lid is raised, the terminal can then be viewed by a worker.

Installed under desk top 17 adjacent the side of end panel 19 is a combination or other lock mechanism 22. The purpose of this mechanism is to lock the chair and desk sections together when they are combined to form a cube, thereby preventing unauthorized use of the work station. To provide access to the combination lock, the upper left corner 15C of the front side panel 15 of the chair section is contoured to create an opening exposing the lock mechanism when the work station is in its storage mode.

In its most basic form, there is no need to provide the desk section with a cubby to accommodate a computer, for the computer and its terminal may be placed on the desk top. Or one could place on the desk top a word processor and its keyboard.

When the work station is to be used by a student, the spaces behind the foldable back rest 13 can serve as a locker to store, say a back pack, while the space under seat 12 can serve to store books or other items. Or a shelf, a basket or a net can be mounted under seat on which items may be placed.

FIGS. 1 and 2 illustrate the station in its active mode in which the interhinged square rear side panels 14 and 18 are in co-planar relation and the desk section and chair section are separated to provide a front entry to the station, permitting a student to occupy seat 12 and work on the adjacent desk top 17.

To convert the work station to a cube and thereby put the station in its storage mode, it is only necessary to fold down back rest 13 to overlie seat 12 and then turn the chair section 10 ninety degrees with respect to desk section 11. When so turned, the half-square front side panel 15 of chair section 10 is in line with and abuts the half-square end panel 19 of desk section 11 to complete a square that defines one face of the resultant cube. The other square faces of the cube as shown in FIG. 3 are constituted by the square rear side panels 14 and 18, the square end panel 16 and the square desk top 17. The square open bottom of the cube rests son the floor.

Work Station Geometry

The geometry of the work station in its active mode is shown in FIG. 4 and in storage mode is shown in FIG. 5. It will be seen in FIG. 4, that chair section 10 occupies a square area and that desk section 11 occupies a contiguous square area. Hence in the active mode, the floor space required by the work station is equal to that of a double square.

FIG. 5 shows the geometry of the work station in its storage mode in which the chair and desk sections 10 and 11 are combined to form-a cube which occupies a single square floor area, one half that of the floor area taken up by the station in its active mode. In practice, the panels may be provided with lockable casters, so to make it easy to shift the station to a desired site by wheeling it to the site and then locking the casters. Or the panels may be provided with other supports, such as spring-loaded feet.

The station in the storage mode, since it assumes the form of a cube, lends itself to stacking in a storage area. Or the cube can be used as a pedestal or platform. Because the cube is locked it acts as a security vault for the computer and other items housed within the cube.

Panel Structures

The panels which form the walls of the work station must be strong structurally in order to survive rough handling in a school or other environment. Yet the panels must be light weight so that the work station can easily be converted from an active to a storage mode, or shifted to another site.

And since the panels are the walls of a nook or enclosure for a single worker, the walls should lend themselves to various uses that are appropriate to a worker's activity. Thus where the activity centers around a computer, the computer operator may need to consult charts, maps or other data pinned to the walls of his station. And if it is a student who has the use of the work station, the student may wish to decorate his walls with school insignia, or to work on a black board.

Figure 6:
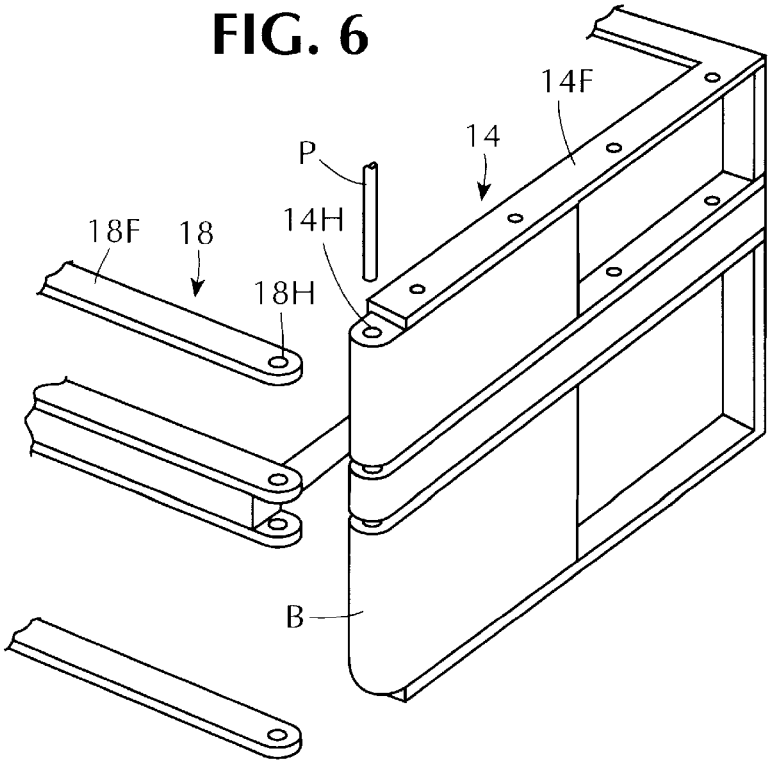
FIG. 6 illustrates the structure of panels included in the work station.

A preferred structure for a strong, light weight work station that includes panels 14 and 18 is illustrated in FIG. 6, panel 14 being the rear side panel of chair section 10 which is hinged to rear side panel 18 of desk section 11.

These panels are each provided with a light weight metal frame (14F and 18F) having a parallel array of aluminum slats which terminate in hinge holes 14H and 18H. These holes are in registration with each other, a hinge pin P being inserted into the holes to interhinge the panels.

The open spaces in the vertical plane between the horizontal metal slats of frames 14F and 18F are occupied by boards B which are pinned to the slats to hold them in place.

The nature of boards B depend on their function. Thus if a board is to serve as a tack board onto which paper sheets can be mounted by means of push pins, then a cork board would be appropriate. In practice, one of the boards may be perforated to serve as a peg board, or the board may be a magnet board on which paper sheets can be mounted by means of small magnetic pieces. Or one of the boards could be a black board.

The simplest form of panel structure without board is to place within a metal frame a slab of rigid foam plastic material having plastic films laminated thereto to form the outer skins of the panel. Or the panel structure may have no frame and be formed of a plywood sheet having Formica facings.

In practice, the hinging of the work station sections is preferably such as to allow the chair section to turn 270 degrees. This rotation range allows work stations to be grouped together in many different ways, such as a side-by-side relation, in pin-wheel clusters, or in a rectangular pattern formed by six units.

In practice, instead of providing seat 12 with a foldable back rest 13 which must be folded down over the seat when putting the work station into its storage mode, use may be made of a short non-foldable backrest whose height is below that of the end panel of the chair section.

It is to be understood that the work station need not in all versions thereof include a locking mechanism, for in versions intended for young children a locking mechanism is inappropriate. Also unnecessary in versions intended for young children is a computer and a computer terminal and a cut-out in the desk top.

In small-scale versions of the convertible work station designed for pre-school children, the term play station may be more appropriate, for the child occupying the chair section uses the desk section to carry out a play activity. Thus the child may draw of paint on the desk section or play with various craft toys.

The play station can be converted into a simulated vehicle by means of plug-in accessories, such as a steering wheel whose steering post plugs into a socket in the desk top, the other accessories being front and rear wheels whose axles plug into sockets formed in the panels of the station. All plug-in accessories, when not in use, can be stored in a basket underlying the table top or seat.

One could also plug into the table top of the work station or elsewhere the pole of a flag or the four poles of an overhead awning. To create a locomotive-driven train from a series of work stations, all of which are provided with simulated wheels, a smoke stack is plugged into the first train, the others having awnings plugged therein.

While there has been shown and described a preferred embodiment of a convertible work station, it will be appreciated that many changes and modifications may be made solo therein without, however, departing from the essential spirit thereof. Thus one or more of the square panels included in the structure of the work station, instead of having a planar surface, may have a contoured surface that is curved, convex, corrugated or otherwise contoured without however interfering with the ability to convert the station from an active mode to a storage mode in which the structure assumes a generally cubical form.

We claim:

1. A convertible work station comprising:

A. a chair section defined by a seat mounted between parallel front side and rear side panels bridged by an end panel to form an alcove, the rear side panel and the end panel each having generally square dimensions, the front side panel having generally half the dimension of the rear side panel; and B. a desk section defined by a square desk top mounted on an L-shaped base having a square rear side panel hinged to the rear side panel of the chair section, and an end panel having generally half the dimension of the rear side panel of the desk section, said station having an active mode in which the interhinged square rear side panels of the sections are in coplanar relation to create a front entry to the work station to permit a worker to occupy the seat and work on the desk top, said station being convertible to a storage mode in which the hinged chair section is turned ninety degrees to bring the front side panel thereof into line with the end panel of the desk section to create one square face of a compact cube whose other square faces are formed by the square desk top, the square end panel and the square rear side panels.

2. A work station as set forth in claim 1 in which the seat is provided with a foldable back rest that in the storage mode overlies the seat.

3. A work station as set forth in claim 1, in which cut into the desk top is a cubby hole below which is a cubby.

4. A work station as set forth in claim 3, in which the cubby hole is provided with a hinged lid which when closed is flush with the surface of the desk top.

5. A work station as set forth in claim 4, in which the cubby is adapted to accommodate a computer having a terminal that is integrated with the lid whereby when the lid is raised, the terminal can then be viewed by the worker.

6. A work station as set forth in claim 1, in which the rear side panel of the desk section and the rear side panel of the chair section each include a metal frame having parallel metal slats.

7. A work station as set forth in claim 6, in which the frame is formed of aluminum.

8. A work station as set forth in claim 6, in which inserted between the parallel metal slats are boards having different functions.

9. A work station as set forth in claim 8, in which one of the boards is a magnetic board.

10. A work station as set forth in claim 8, in which one of the boards is a peg board.

11. A work station as set forth in claim 8, in which one of the boards is a black board.

12. A work station as set forth in claim 1, in which one of said boards is a tack board.

13. A work station as set forth in claim 1, in which the chair sections hinged to the desk section is rotatable in a range of 270 degrees.

14. A work station as set forth in claim 1, in which the seat is provided with a fixed back rest whose height is below that of the end panel of the chair section.

15. A work station as set forth in claim 1, in which at least one of the square panels has a contoured surface.

16. A work station as set forth in claim 15, in which at least one of the square panels has a corrugated surface.

* * * * *